US005285598A

United States Patent [19]

Arita et al.

[11] Patent Number: 5,285,598

[45] Date of Patent: Feb. 15, 1994

[54] METHOD FOR DRILLING A PROCESSED HOLE TO A HARD BUT BRITTLE MATERIAL AND A DEVICE THEREFOR

[75] Inventors: Tomoo Arita, Tokyo; Toshihiko Hirabayashi, Higashikurume, both of Japan

[73] Assignees: Asahi Diamond Kogyo Kabushiki Kaisha; Kyokuei Kenmakako Kabushiki Kaichi, Tokyo, Japan

[21] Appl. No.: 940,676

[22] Filed: Sep. 4, 1992

[30] Foreign Application Priority Data

Sep. 6, 1991 [JP] Japan ..... 3-254293

[51] Int. Cl.[5] ..... B24B 25/00

[52] U.S. Cl. ..... 51/283 R; 408/1 R

[58] Field of Search ..... 51/283 R, 90, 98 R, 51/281 R, 290, 119, 120; 408/145, 204, 1

[56] References Cited

U.S. PATENT DOCUMENTS 4,468,159 8/1984 Oster ..... 408/56

4,483,108 11/1984 Howard ..... 51/283 R 4,800,686 1/1989 Hirabayashi ..... 51/283 R

FOREIGN PATENT DOCUMENTS 0585989 12/1977 U.S.S.R. ..... 51/283 R

*Primary Examiner*—Jack Lavinder

*Attorney, Agent, or Firm*—Hayes, Soloway, Hennessey & Hage

[57] ABSTRACT

A rotating diamond core drill is contacted with a hard but brittle material, and by keeping contact relation with the material, drilling operation is continued to drill a hole to the material. Further, when a hole is bored, relative eccentrical motion is given between the diamond core drill and the material so that the whole inner circumferential surface of the hole can be contacted with the rotating diamond core drill, and drilling speed of the diamond core drill is reduced. Accordingly, drilling and cutting pressure applied to the material is reduced and no breaking-offs is generated.

2 Claims, 1 Drawing Sheet

Fig. 1
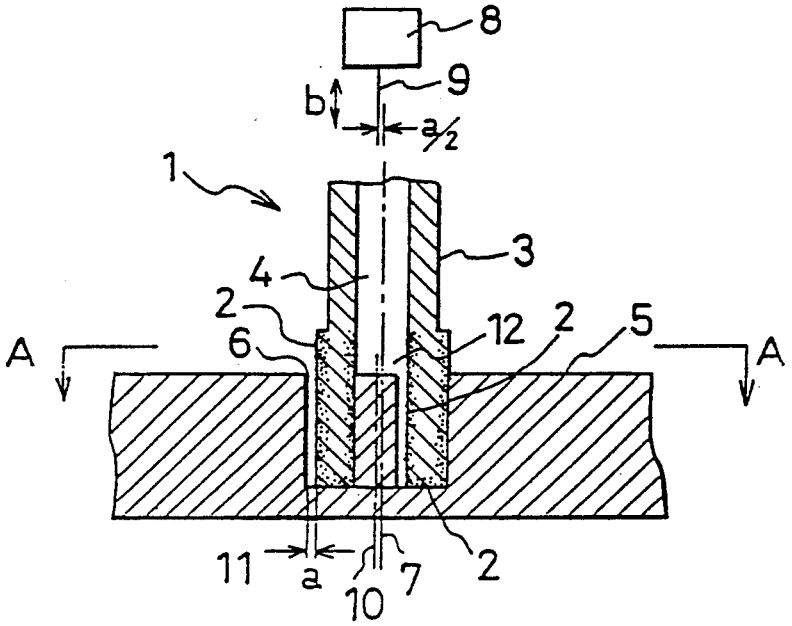
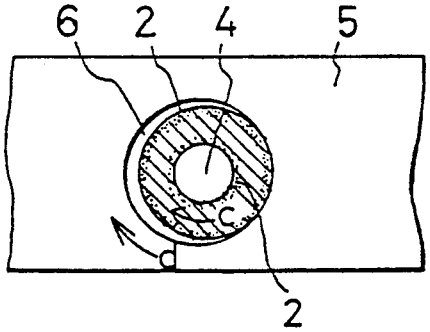
Fig. 2
Fig. 3
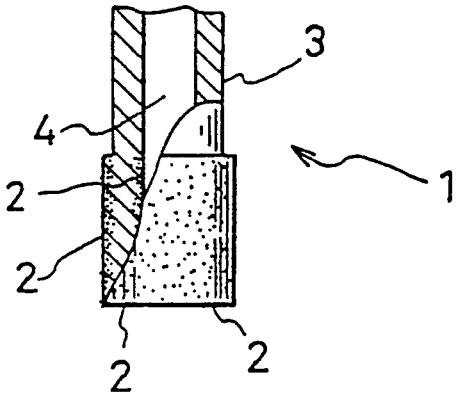

METHOD FOR DRILLING A PROCESSED HOLE TO A HARD BUT BRITTLE MATERIAL AND A DEVICE THEREFOR

BACKGROUND OF THE INVENTION

Prior Art

The present invention relates to a method for drilling a processed hole to a hard but brittle material and a device for carrying out the method. A diamond core drill (1) is, as shown in FIG. 3, a device having for a diamond whetstone part (2) which is mounted on the top end of a steel shank (3) for drilling a hole to a material to be processed. In general the diamond core drill is provided with a penetrating part (4) at the central portion of a drill.

The diamond core drill is excellent both in processing efficiency and processing accuracy for drilling a hole to a hard and brittle material, however, there has been a fault to generate breaking-offs at an opening edge of the drilled hole.

The breaking-offs impair not only accuracy and beautiful appearance, but also are apt to cause cracks to break materials such as plate glasses etc.

Breaking-offs are generated at the side of a material to be drilled from which the diamond core drill falls out, when the drill penetrates the material, such as a plate glass, to be drilled. Therefore, in order to prevent breaking-offs, in conventional, one of the methods for drilling a hard but brittle material especially such as a plate glass or the like, drilling operation is carried out from both sides thereof in which at first the drilling operation is begun from one side of the plate glass and continued till depth of a hole drilled therein reaches to about a half of thickness of the plate glass, and then, the drilling operation is carried out from a oppositely corresponding position of the other side of the plate glass that a hole drilled from the other side thereof may communicate with the firstly drilled hole to complete a penetrating hole at their meeting part, that is, about at the center of the plate glass thickness.

However, in the afore-described conventional method of drilling material such as plate glass or the like from the both sides thereof, two spindles must be disposed to exactly oppose with each other in keeping coaxial relation, however, accurate coaxial relation between the two spindles is not always achieved which results in difference at the meeting point of the two holes.

Further, in this conventional method though no breaking-off is generated at the opening part of the hole, there generate several causes to lead crackings at the penetrated part, that is, at the meeting part of the two holes. To solve the afore-described disadvantage other method has been proposed in which drills having somewhat different diameters are used at both sides, respectively. However, in this method there is also disadvantage to occur a stepped portion in the hole.

The present invention is aimed to solve the afore-described disadvantages of the conventional methods. According to the present invention, a penetrating hole can be drilled to a hard but brittle material such as plate glass or the like without generating any breaking-offs by using a single diamond core drill from one side of the material to be drilled.

SUMMARY OF THE INVENTION

To achieve the afore-described objects, in a bore-processing method according to the present invention in which a hole is bored in a hard but brittle material such as a plate glass or the like by a diamond core drill, it is characterized that the diamond core drill is rotated and contacted with the hard but brittle material, and by keeping the contacting relation with it, an eccentrical motion is given between the rotating diamond core drill and the material to be drilled so that the rotating diamond core drill can contact with the material, and after a hole being drilled it can contact withover the whole inner circumferential surface of the hole, and further, drilling speed of the diamond core drill is reduced in the vicinity of the penetrated side, that is, the side of the material from which the diamond core drill falls out.

Further, a device for drilling processed a hole to a hard but brittle material according to the present invention is characterized by comprising a rotating means which rotates a diamond core drill around a shaft of the diamond core drill which is provided with diamond whetstone parts at the top end thereof, a means for giving eccentrical movement between the diamond core drill and the hard but brittle material and means for controlling drilling speed of the diamond core drill.

Operation

According to the bore-processing method of the present invention, in order to a rotating diamond core drill being kept contacting with a hard but brittle material to be processed so that the whole inner circumferential surface of the material can keep contacting with the roting diamond core drill, relative eccentrical motion is given between the rotating diamond core drill and the hard but brittle material. An the drilling speed of the diamond core drill is reduced in the vicinity of the opening of the penetrated side hole from which the diamond core drill falls out, so that drilling and grinding pressure applying to the opening part of the material which turns thinner attenuates which results in generating no breaking-offs from the inlet (opening) of the hole to the opening from which the diamond core drill falls out.

In addition, according to the device for drilling a processed hole of the present invention, operation for drilling a processed hole to a hard but brittle material can be achieved from one side of the material to be processed by a single diamond core drill.

BRIEF DESCRIPTION OF THE DRAWINGS

FIG. 1 is a view for explaining a method for drilling a processed hole according to the present invention.

FIG. 2 is a sectional view cut along A—A line in FIG. 1 and shows eccentrical motion between a diamond core drill and a plate glass according to the present invention.

FIG. 3 is a partially exploded front view of a conventionally used diamond core drill.

DETAILED DESCRIPTION OF THE PREFERRED EMBODIMENT

Hereinafter, the present invention is explained basing on an embodiment with reference to the accompanying with the drawings. FIG. 1 is a view showing one embodiment of the method for drilling a processed hole to a hard but brittle material and a device used for the method according to the present invention.

The diamond core drill (1) is composed of, as same as that of shown in FIG. 3, a diamond whetstone part (2) which is equipped with diamonds at the top end surface and both the inner and the outer circumferential surfaces, a shank (3) of steel and an axial center penetrating part (4). The diamond whetstone part (2) is made of metal-bonded whetstone or electrodeposited whetstone. The metal-bonded whetstone has long durable years but expensive in manufacturing cost because of its complicate configuration. However, the electrodeposited whetstone can be easily manufactured to any desired configuration with high accuracy.

When a hole is drilled to a hard but brittle material, that is, a plate glass (5), the diamond whetstone part (2) of the diamond core drill (1) is contacted with the plate glass (5) to drill a hole (6), and by keeping the contacting part with the inner circumferential surface of the hole (6), relative eccentrical motion is given between the drill (1) which is rotated around a rotating axis (7) of the diamond core drill (1) (the rotating axis (7) is located at a position having a distant of a/2 from the central axis (10) of the hole (6)) and the plate glass (5) so that the contacting part can extend over the whole circumferential surface of the hole. Here, "a" is the largest distance between the outer circumferential surface of the diamond core drill (1) and the inner circumferential surface of the hole (6).

As methods for giving the relative eccentrical motion between the diamond core drill (1) and the plate glass (5), there is one method as follows, that is, in the method the plate glass (5) is stood still, a rotating axis (9) of a motor (8) is coincided with the central axis (10) of the hold (6), and by coupling a linking member (not shown) on the rotating axis (7) with coupling means such as a crank pin (not shown), the axis (7) of the diamond core drill (1) is rotated around the central axis (10) of the hole (6) by the motor (8).

The afore-described motion is explained as follows with reference to FIG. 2. The circumferential surface of the diamond whetstone part (2) is contacted with the inner circumferential surface of the hole (6) and rotating it in the direction c, the diamond core drill (1) is planetarily rotated so that the diamond whetstone part (2) may be rotated in the d direction to extend the contacting part over the whole circumferential surface of the hold (6).

Further, there are other methods, for example, a method in which the plate glass (5) is rotated, while the diamond core drill (1) is moved horizontally, or other method in which the diamond core drill (1) is stood still and the plate glass (5) is moved in horizontal direction by rotating itself concentrically with the hole (6).

Instead of rotating the plate glass (5), no rotation circular movement also can be applied. In addition, there is a further unique method in which the plate glass (5) is fixed on an XY stage, no rotation circular movement can be made by the control of an XY two coordinates NC (numeric control), and further, by the control of three coordinates which includes added Z-coordinate for the diamond core drill (1), the whole processes can be performed automatically. The important point is to carry out relative eccentrical motion between the diamond core drill (1) and the plate glass (5).

Drilling speed of the diamond core drill (1) is controlled to reduce in the vicinity of an opening (11) of the side of the plate glass (5) from which the diamond core drill (1) falls out. For example, in the case of drilling a penetrating hole to a plate glass having thickness of 3.5 mm for about 6 seconds, ¾ of the thickness (thickness of 2.625 mm) is drilled for 3 seconds, and then, drilling speed is gradually reduced so that the remaining ¼ of the thickness (0.875 mm) can be drilled for 3 seconds to complete the penetrating hole.

As the means for controlling drilling speed of the diamond core drill (1) there are some means and one of which is to provide a feeding mechanism which moves in both upper and lower directions (directions b in FIG. 1) on the rotating axis (9) of the motor (8) for controlling the drilling speed. In this case the speed control may be carried out manually, or may be automatically performed by utilizing cam means or coordinates control of an NC (numeric control) apparatus.

Accordingly, cracks which conventionally generated in the vicinity of the opening of the hole (6) when the top end surface of the diamond whetstone part (2) of the diamond drill (1) contacted with the plate glass (5) are cut out in a moment at the circumferential surface part of the diamond whetstone part (2) by planetary motion of the diamond core drill (1), and thus, drilling operation continues.

As described the above, because of multiplied effect resulted by multiplying relative eccentrical motion between the diamond core drill (1) and the plate glass (5) by speed reduction in drilling operation in the vicinity of the opening part (11) of the side of the hole (6) from which the diamond core drill (1) falls out, cutting and grinding pressure applied to the vicinity (in which thickness of the glass becomes thinner) of the opening part (11) of the plate glass (5) is reduced. Therefore, from the inlet opening at one side to the opening part (11) of the other side of the plate glass (5) generation of breaking-offs is reduced remarkably.

In the case of drilling a hole to the plate glass (5), if water (12) is supplied to the axial center penetrating part (4) of the diamond core drill (1), the water (12) flows by passing through the top end surface of the diamond whetstone part (2) and a gap made between the outer circumferential surface of the diamond core drill (1) and the inner circumferential surface of the hole (6). Since the water (12) flows out efficiently, high cooling effect can be expected and cutted powders of glass and dropped powders of diamond whetstone are quickly discharged, which results in extending durable life of the diamond core drill (1).

After the hole (6) having been penetrated, the diamond core drill (1) is again contacted with the inner circumferential surface of the hole (6), and keeping the contact relation therewith, the diamond core drill (1) is moved to make a planetary movement of large diameter around the central axis (10) of the hole (6). Thus, the hole (6) can be made larger and finish processing can be achieved.

In general the more taper the tip end of the diamond core drill (1) is, the smaller breaking-offs in the vicinity of the opening part (11) of the hole (6) when it is penetrated, for an area in the drilling direction is small at a position where the plate glass contacts with the tip end of the drill. In the case of practising the present invention, since the rotation of the drill is also accompanied with eccentrical movement, as the drill is used, the tip end of the drill is apt to become taper which can bring out secondary effect that breaking-offs at the margin of the opening part (11) become smaller.

EFFECT OF THE INVENTION

As heretofore described, in the present invention there are effects as follows. In the invention claimed, (a) Because of multiplied effect caused by the relative eccentrical motion between the diamond core drill and the hard but brittle material and the reduced drilling speed in the vicinity of the opening part of the side of the hole from which the diamond core drill falls out, drilling and cutting pressure applied to the thinned opening part of the hole attenuates, so that no breaking-offs is generated, especially at the opening part.

(b) In the penetrated part in the inside of the hole there occurs no crack, no discrepancy or stepped difference.

In the invention claimed, water supplied to the axial penetrating part of the diamond core drill flows out through a gap between the outer circumferential surface of the diamond core drill and the inner circumferential surface of the hard but brittle material made by the relative eccentrical motion between the diamond core drill and the material, so that high cooling efficiency can be obtained, and powders of cutted or ground glass and dropped powders of diamond whetstone part are discharged quickly, and further, drilling speed of the diamond core drill can be increased and durable life of the diamond core drill can also be extended.

In the invention claimed, the diamond core drill is contacted with the inner circumferential surface of the penetrated hole and relative eccentrical motion is given between the diamond core drill and the material, so that the hole can be enlarged and good finishing can be expected.

In the invention claimed, the drilling operation can be carried out from one side of the material only by a single tool, by a diamond core drill, so that high processing efficiency can be achieved.

What is claimed is:

1. In a method for drilling a processed hole into a hard but brittle material, by using a diamond core drill characterized by comprising the steps of:

contacting a rotating diamond core drill to one side of a hard but brittle material to bore a hole;

giving relative eccentrical motion between said rotating diamond core drill and said hard but brittle material so that said rotating diamond core drill contacts the inner circumferential surface of the hole in said hard but brittle material, supplying water to an axial center of a penetrating part of said diamond core drill; and gradually reducing rotational speed of said diamond core drill near by the bottom of said hard but brittle material to be penetrated:

the improvement wherein said drilling operation of said diamond core drill is carried out by drilling the material to a distance of $\frac{3}{4}$ of the thickness of said material in half of a necessary time for completing a penetrated hole, and then gradually reducing the drilling speed of said diamond core drill so that the remaining $\frac{1}{4}$ of the thickness of the material is drilled in the remaining half of the necessary time for completing the penetrated hole.

2. A method for drilling a processed hole into a hard but brittle material according to claim 1, wherein said material is a plate glass of thickness 3.5 mm and necessary time for completing a penetrating hole is 6 seconds.

* * * * *